US009037357B2

(12) United States Patent
Kawasaki et al.

(10) Patent No.: US 9,037,357 B2
(45) Date of Patent: May 19, 2015

(54) CONTROL SYSTEM FOR HYBRID CONSTRUCTION MACHINE

(75) Inventors: Haruhiko Kawasaki, Atsugi (JP); Masahiro Egawa, Kawaguchi (JP)

(73) Assignee: KAYABA INDUSTRY CO., LTD., Tokyo (JP)

( * ) Notice: Subject to any disclaimer, the term of this patent is extended or adjusted under 35 U.S.C. 154(b) by 622 days.

(21) Appl. No.: 13/512,856

(22) PCT Filed: Feb. 10, 2011

(86) PCT No.: PCT/JP2011/052855
§ 371 (c)(1),
(2), (4) Date: May 30, 2012

(87) PCT Pub. No.: WO2011/102292
PCT Pub. Date: Aug. 25, 2011

(65) Prior Publication Data

US 2012/0233998 A1 Sep. 20, 2012

(30) Foreign Application Priority Data

Feb. 18, 2010 (JP) ..... 2010-33526

(51) Int. Cl.

| | |
|---|---|
| ***E02F 9/22*** | (2006.01) |
| ***F15B 21/14*** | (2006.01) |
| ***E02F 9/20*** | (2006.01) |
| ***F15B 21/04*** | (2006.01) |

(52) U.S. Cl.

CPC ..... *E02F 9/2217* (2013.01); *E02F 9/2075* (2013.01); *E02F 9/2282* (2013.01); *E02F 9/2285* (2013.01); *E02F 9/2292* (2013.01); *E02F 9/2296* (2013.01); *F15B 21/042* (2013.01); *F15B 21/14* (2013.01); *F15B 2211/20576* (2013.01); *F15B 2211/88* (2013.01)

(58) Field of Classification Search

USPC ..... 701/50

See application file for complete search history.

(56) References Cited

U.S. PATENT DOCUMENTS

| | | | | |
|---|---|---|---|---|
| 5,372,214 | A * | 12/1994 | Haga et al. | 180/422 |
| 6,851,207 | B2 * | 2/2005 | Yoshimatsu | 37/348 |
| 2002/0061803 | A1 * | 5/2002 | Aoki | 477/3 |
| 2002/0091034 | A1 * | 7/2002 | Nakamori et al. | 477/3 |
| 2003/0190995 | A1 * | 10/2003 | Aoki | 477/5 |
| 2005/0246082 | A1 * | 11/2005 | Miki et al. | 701/50 |
| 2007/0227802 | A1 * | 10/2007 | O'Brien, II | 180/307 |
| 2008/0038136 | A1 * | 2/2008 | O'Brien, II | 418/63 |
| 2010/0186404 | A1 * | 7/2010 | Yasufuku et al. | 60/459 |
| 2011/0010047 | A1 | 1/2011 | Kawasaki et al. | |

FOREIGN PATENT DOCUMENTS

| | | | |
|---|---|---|---|
| DE | 11 2009 000 682 | T5 | 2/2011 |
| JP | 2002-275945 | A | 9/2002 |
| JP | 2003049810 | A | 2/2003 |
| JP | 2006-083550 | A | 3/2006 |
| JP | 2009-299719 | | 12/2009 |
| JP | 2009287745 | A | 12/2009 |

* cited by examiner

*Primary Examiner* — Shelley Chen
(74) *Attorney, Agent, or Firm* — Rabin & Berdo, P.C.

(57) ABSTRACT

A regeneration switching valve which communicates with a neutral flow path and a tank at a normal position and cuts off communication between the neutral flow path and the tank to cause the neutral flow path to communicate with a hydraulic motor for power generation at a switched position is provided in at least one of first and second circuit systems including a plurality of control valves.

4 Claims, 1 Drawing Sheet

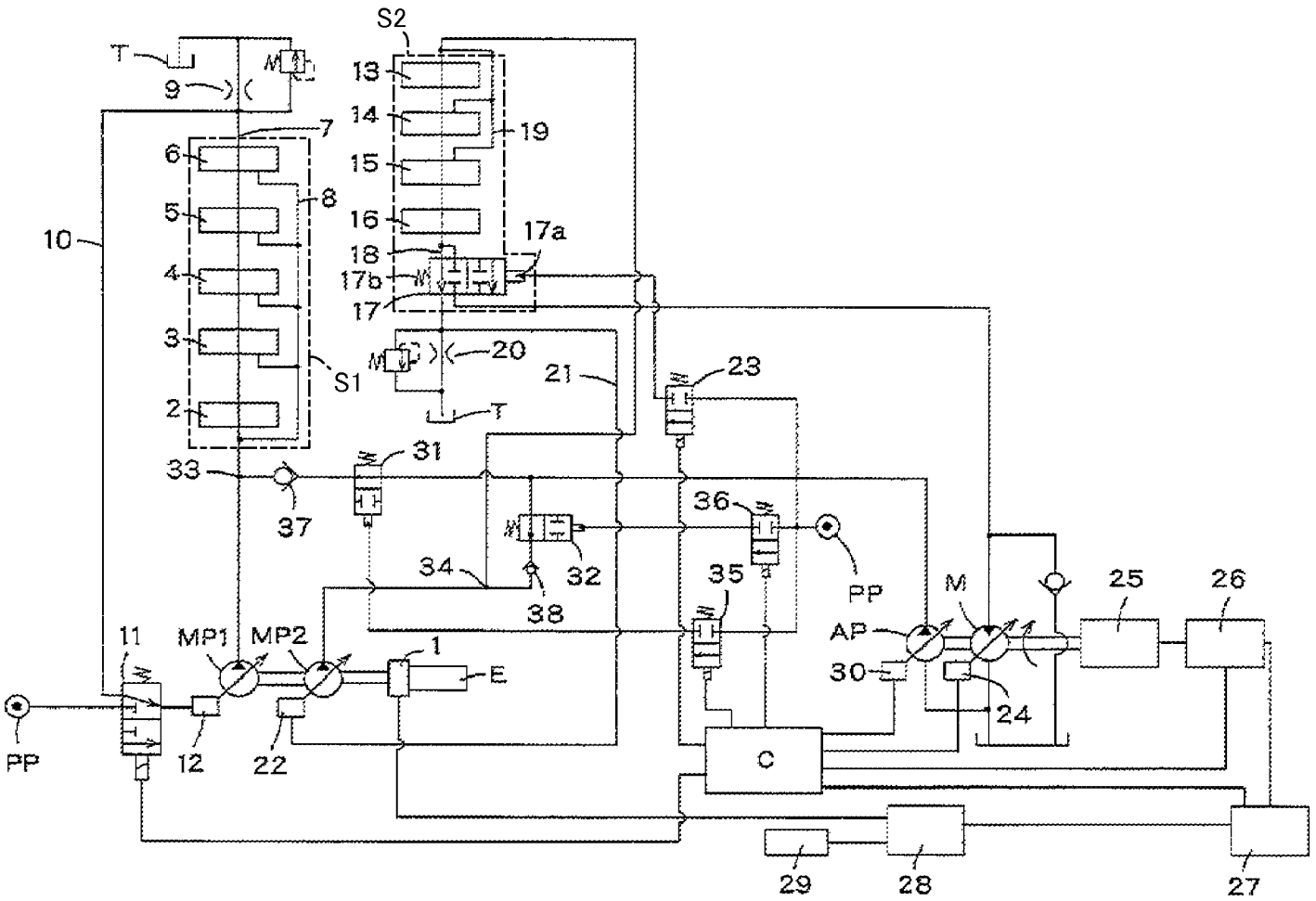
S2
13
14
15
16
18
17b
17
17a
19
20
21
T
S1
7
8
9
6
5
4
3
2
10
T
23
36
35
PP
AP
30
M
24
25
26
27
28
29
C
32
38
34
31
33
37
E
1
MP2
MP1
22
12
11
PP

CONTROL SYSTEM FOR HYBRID CONSTRUCTION MACHINE

TECHNICAL FIELD

This invention relates to a control system for hybrid construction machine.

BACKGROUND ART

JP2002-275945A discloses a hybrid construction machine including an engine, a generator which is driven by the engine, a battery for storing power generated by the generator and an electric motor which is driven by power of a battery.

SUMMARY OF INVENTION

The applicant filed Japanese Patent Application No. 2009-164279 relating to a construction machine of this type. An invention according to this application is such that oil discharged from a variable-capacity main pump is supplied to a hydraulic motor for power generation when control valves for controlling actuators are all kept at neutral positions, i.e. when the respective actuators are in an inoperative state.

When the discharged oil from the main pump is introduced to the hydraulic motor for power generation, a switching valve provided between the control valves and the main pump is switched to cut off connection between the main pump and the control valves and the discharged oil from the main pump is supplied to the hydraulic motor for power generation.

However, since the connection between the main pump and the control valves is cut off in this construction when the discharged oil from the main pump is supplied to the hydraulic motor for power generation, the control valves are quickly cooled, for example, in cold regions. If the control valves are excessively cooled, a stucking phenomenon occurs between valve main bodies and spools of the control valves when the discharged oil from the main pump is supplied again to the control valves to actuate the actuators. The reason for this is as follows.

Specifically, the discharged oil from the main pump maintains high oil temperature also while the control valves are not operated. Further, the control valves are normally such that the valve main bodies thereof are made of cast metal and the spools thereof are made of steel. Since the valve main bodies and the spools are both made of metal, but different materials, thermal expansion differs.

Accordingly, if the discharged oil from the main pump maintained at a high oil temperature is supplied to the control valves in a cold state, the valve main bodies and the spools are stucked due to different thermal expansions. Particularly in recent construction machines, an engine is stopped in an inoperative state to save energy. Thus, valve main bodies are easily cooled and this problem becomes further significant.

This invention aims to provide a control system for hybrid construction machine in which control valves are difficult to cool also while oil discharged from a main pump is supplied to a hydraulic motor for power generation.

One aspect of the present invention is directed to a control system for hybrid construction machine, including a pair of variable-capacity first and second main pumps, the discharge amounts of which are controlled by a control mechanism; first and second circuit systems connected to the first and second main pumps; a hydraulic motor for power generation which rotates when oil discharged from at least one of the first and second main pumps is supplied; a generator coupled to the hydraulic motor for power generation; a battery which stores power generated by the generator; a plurality of control valves provided in the first and second circuit systems; a tank; a neutral flow path which introduces the oil discharged from the first and second main pumps to the tank when all of the plurality of control valves are at neutral positions; and a regeneration switching valve which is provided in at least one of the first and second circuit systems, communicates with the neutral flow path and the tank at a normal position, and cuts off communication between the neutral flow path and the tank at a switched position to cause the neutral flow path to communicate with the hydraulic motor for power generation.

According to the above aspect, since the oil discharged from at least one of the main pumps goes through the control valves of the circuit systems in the case of supplying the oil discharged from the main pump(s) to the hydraulic motor for power generation, the control valves are heated by hydraulic oil supplied to the hydraulic motor for power generation. Therefore, a problem of stucking valve main bodies and spools does not occur.

An embodiment of the present invention and advantages thereof are described in detail below with reference to the accompanying drawing.

BRIEF DESCRIPTION OF DRAWING

FIG. 1 is a hydraulic circuit diagram of an embodiment of the present invention.

EMBODIMENT OF INVENTION

An illustrated embodiment is a control system of a power shovel. First and second main pumps MP1, MP2 have a variable capacity and are driven by an engine E. The first and second main pumps MP1, MP2 rotate coaxially. A generator 1 is provided in the engine E and generates power utilizing remaining power of the engine E.

The first main pump MP1 is connected to a first circuit system S1. To the first circuit system S1 are connected a control valve 2 for controlling a rotation motor, a control valve 3 for controlling an arm cylinder, a control valve 4 for boom second speed for controlling a boom cylinder, a control valve 5 for controlling an auxiliary attachment and a control valve 6 for controlling a motor for left travel in this order from an upstream side.

The respective control valves 2 to 6 are connected to the first main pump MP1 via a neutral flow path 7 and a parallel passage 8.

A throttle 9 for pilot pressure control for generating a pilot pressure is provided downstream of the control valve 6 for the left travel motor in the neutral flow path 7. The throttle 9 generates a high pilot pressure at an upstream side if a flow rate through the throttle 9 is high while generating a low pilot pressure if the flow rate is low.

The neutral flow path 7 introduces all or part of oil discharged from the first main pump MP1 to a tank T via the throttle 9 when all the control valves 2 to 6 are at or near neutral positions. In this case, a high pilot pressure is generated since the flow rate through the throttle 9 is high.

If the control valves 2 to 6 are switched to full-stroke states, the neutral flow path 7 is closed and a fluid does not flow any longer. In this case, the flow rate through the throttle 9 becomes zero and the pilot pressure is kept at zero.

However, depending on the operating amounts of the control valves 2 to 6, part of the pump-discharged oil is introduced to actuators and part thereof is introduced to the tank T from the neutral flow path 7. Thus, the throttle 9 generates a pilot pressure corresponding to the flow rate in the neutral flow path 7. In other words, the throttle 9 generates the pilot pressure corresponding to the operating amounts of the control valves 2 to 6.

A pilot flow path 10 is connected between the control valve 6 in the neutral flow path 7 and the throttle 9. The pilot flow path 10 is connected to a regulator 12 for controlling a tilting angle of the first main pump MP1 via an electromagnetic switching valve 11.

The regulator 12 controls the tilting angle of the first main pump MP1 in inverse proportion to a pilot pressure in the pilot flow path 10 to control a displacing amount per rotation of the first main pump MP 1. Accordingly, if there is no more flow in the neutral flow path 7 and the pilot pressure is zeroed by setting the control valves 2 to 6 in the full-stroke states, the tilting angle of the first main pump MP1 is maximized to maximize the displacing amount per rotation of the first main pump MP1.

A pilot pump PP is connected to the electromagnetic switching valve 11. The electromagnetic switching valve 11 selectively introduces pressures in the pilot flow path 10 and the pilot pump PP to the regulator 12. The electromagnetic switching valve 11 is switched in accordance with an output signal of controller C.

That is, the electromagnetic switching valve 11 is kept at a shown normal position to introduce the pressure in the pilot flow path 10 to the regulator 12 in a state where no signal is output from the controller C to the electromagnetic switching valve 11. When a signal from the controller C is input to the electromagnetic switching valve 11, the electromagnetic switching valve 11 is switched from the normal position to a switched position to introduce the pressure of the pilot pump PP to the regulator 12.

The second main pump MP2 is connected to a second circuit system S2. To the second circuit system S2 are connected a control valve 13 for controlling a motor for right travel, a control valve 14 for controlling a bucket cylinder, a control valve 15 for controlling the boom cylinder BC, and a control valve 16 for arm second speed for controlling the arm cylinder in this order from an upstream side. A regeneration switching valve 17 is connected at a side further downstream of the control valve 16.

The respective control valves 13 to 16 are connected to the second main pump MP2 via a neutral flow path 18. The control valves 14 and 15 are connected to the second main pump MP2 via a parallel passage 19.

A throttle 20 for pilot pressure control is provided downstream of the regeneration switching valve 17 in the neutral flow path 18. The throttle 20 functions in just the same manner as the throttle 9 of the first circuit system S1.

The regeneration switching valve 17 causes the neutral flow path 18 and the throttle 20 to communicate at a shown normal position. The regeneration switching valve 17 cuts off communication between the neutral flow path 18 and the throttle 20 and causes the neutral flow path 18 to communicate with a hydraulic motor M for power generation when being switched from the normal position to a switched position.

A pilot flow path 21 is connected between the regeneration switching valve 17 in the neutral flow path 18 and the throttle 20. The pilot flow path 21 is connected to a regulator 22 for controlling a tilting angle of the second main pump MP2.

The regulator 22 controls the tilting angle of the second main pump MP2 in inverse proportion to a pilot pressure in the pilot flow path 21 to control a displacing amount per rotation of the second main pump MP2. Accordingly, if there is no more flow in the neutral flow path 18 and the pilot pressure is zeroed by setting the control valves 13 to 16 in the full-stroke states, the tilting angle of the second main pump MP2 is maximized to maximize the displacing amount per rotation of the second main pump MP2.

A pilot chamber 17*a* is provided at one side of the regeneration switching valve 17 and a spring force of a spring 17*b* acts on a side opposite to the pilot chamber 17*a*. Accordingly, when no pilot pressure acts on the pilot chamber 17*a*, the regeneration switching valve 17 is kept at the shown normal position by the action of the spring force of the spring 17*b* to cause the neutral flow path 18 and the throttle 20 to communicate and cut off communication between the neutral flow path 18 and the hydraulic motor M for power generation.

When the pilot pressure is introduced to the pilot chamber 17*a*, the regeneration switching valve 17 is switched to the switched position against the spring force of the spring 17*b* to cut off communication between the neutral flow path 18 and the throttle 20 and cause the neutral flow path 18 to communicate with the hydraulic motor M for power generation.

The pilot chamber 17*a* of the regeneration switching valve 17 is connected to the pilot pump PP via a pilot electromagnetic control valve 23. The pilot electromagnetic control valve 23 is controlled by an output signal of the controller C. That is, the pilot electromagnetic control valve 23 is normally kept at a shown closed position and switched to an open position in accordance with an output signal of the controller C.

When the pilot electromagnetic control valve 23 is switched to the open position, the pilot pressure of the pilot pump PP is introduced to the pilot chamber 17*a* of the regeneration switching valve 17, whereby the regeneration switching valve 17 is switched to the switched position to be set in an open state for the hydraulic motor M for power generation. Accordingly, the communication between the neutral flow path 18 and the throttle 20 is cut off and pressure oil having flowed into the neutral flow path 18 is supplied to the hydraulic motor M for power generation to rotate the hydraulic motor M for power generation.

A tilting angle of the hydraulic motor M for power generation is controlled by a tilting angle controller 24. The titling angle controller 24 is controlled by an output signal of the controller C.

Since the hydraulic motor M for power generation is coupled to a generator 25, the generator 25 rotates to generate power and charge a battery 27 with the generated power via an inverter 26 when the hydraulic motor M for power generation rotates. The controller C has a function of monitoring the charged amount of the battery 27.

A battery charger 28 charges the battery 27 with power generated by the generator 1. In this embodiment, the battery charger 28 is also connected to a power supply 29 of another system such as a power supply for domestic use.

An assist pump AP is provided which rotates in cooperation with the hydraulic motor M for power generation. The assist pump AP also includes a tilting angle controller 30 controlled by the controller C.

The assist pump AP is connected to junctions 33, 34 between the first and second main pumps MP1, MP2 and the first and second circuit systems S1, S2 via first and second junction control valves 31, 32. Each of the first and second junction control valves 31, 32 includes a pilot chamber at one side thereof and a spring at a side opposite to the pilot chamber. The first and second junction control valves, 31, 32 are kept at open positions in the shown normal state and switched to closed positions against the springs when the pilot pressure acts on the pilot chambers.

The pilot chambers of the first and second junction control valves 31, 32 are connected to the pilot pump PP via first and second electromagnetic control valves 35, 36. The first and second electromagnetic control valves 35, 36 are controlled by output signals of the controller C and kept at closed positions in the shown normal state to cut off communication between the pilot pump PP and the pilot chambers of the first and second junction control valves 31, 32.

When the first and second electromagnetic control valves 35, 36 are switched to the open positions by output signals of the controller C, a discharge pressure of the pilot pump PP is introduced to the pilot chambers of the first and second junction control valves 31, 32. Accordingly, in this case, the first and second junction control valves 31, 32 are switched to the closed positions to cut off communication between the assist pump AP and the junctions 33, 34.

Check valves 37, 38 allow only flows from the assist pump AP to the junctions 33, 34.

Next, functions of this embodiment are described.

If a regeneration signal is input from an operator when all the control valves 2 to 6 and 13 to 16 of the first and second circuit systems S1, S2 are kept at the neutral positions and the regeneration switching valve 17 is at the shown normal position, the controller C switches the pilot electromagnetic control valve 23 to the open position. When the pilot electromagnetic control valve 23 is switched to the open position, the discharge pressure of the pilot pump PP acts on the pilot chamber 17*a* of the regeneration switching valve 17, wherefore the communication between the neutral flow path 18 and the throttle 20 is cut off and there is no more flow through the throttle 20.

Since a pressure at a side upstream of the throttle 20 is zeroed if there is no more flow through the throttle 20, the regulator 22 accordingly maximizes the tilting angle of the second main pump MP2 to maximize the displacing amount per rotation of the second main pump MP2. Discharged oil from the second main pump MP2, the displacing amount of which is maximized, is supplied from the neutral flow path 18 to the hydraulic motor M for power generation via the regeneration switching valve 17 to rotate the hydraulic motor M for power generation. As the hydraulic motor M for power generation rotates, the generator 25 rotates to generate power and the generated power is stored in the battery 27 via the inverter 26.

The controller C determines whether or not the storage amount of the battery 27 is sufficient based on a set value stored beforehand. The controller C commands a large absorption torque of the generator 25 to increase the pressure acting on the hydraulic motor M for power generation when judging that the storage amount is insufficient. That is, the controller C controls an input torque to the hydraulic motor M for power generation according to the storage amount of the battery 27.

When the regeneration signal is input from the operator, the controller C switches the electromagnetic switching valve 11 to cause the discharge pressure of the pilot pump PP to act on the regulator 12 to keep the displacing amount per rotation of the first main pump MP1 at a minimum level.

As described above, since the regeneration switching valve 17 is provided downstream of the control valves 13 to 16 in this embodiment, the discharged oil from the second main pump MP2 goes through all the control valves 13 to 16 of the second circuit system S2. In other words, high-temperature oil circulating between the second main pump MP2 and the hydraulic motor M for power generation passes through all the control valves 13 to 16. Thus, the valve main bodies of the control valves 13 to 16 are reliably heated.

Further, since a minimum standby flow rate of the first main pump MP1 flows into the control valves 2 to 6 of the first circuit system S1, these control valves 2 to 6 are also heated.

In any case, while the hydraulic motor M for power generation is rotated to generate power, the valve main bodies of all the control valves 2 to 6 and 13 to 16 are heated since high-temperature oil circulates in the first and second circuit systems S1, S2. Therefore, the valve main bodies and the spools are not stucked due to the cold valve main bodies.

In addition, only the oil discharged from the second main pump MP2, the displacing amount per rotation of which is maximized, is supplied to the hydraulic motor M for power generation and the displacing amount per rotation of the first main pump MP1 is minimized, wherefore power loss can be minimized by as much as a reduction in the discharge amount of the first main pump MP1.

Although the regeneration switching valve 17 is provided at the most downstream side of the control valves 13 to 16 in this embodiment, it may be not necessarily provided at the most downstream side. However, the respective control valves 13 to 16 can be reliably and efficiently heated if the regeneration switching valve 17 is provided at the most downstream side as in this embodiment.

The regeneration switching valve 17 may be provided in the first circuit system Si, preferably at the most downstream side of the control valves 2 to 6 of the first circuit system Si. The regeneration switching valve 17 may be provided in both the first and second circuit systems S1, S2.

When the regeneration signal is input from the operator in a state where the actuator connected to any one of the control valves of the first circuit system S1 is actuated and the control valves 13 to 16 of the second circuit system S2 are kept at the neutral positions, the controller C keeps the electromagnetic switching valve 11 at the shown normal position, causes the first main pump MP1 connected to the first circuit system S1 to ensure a discharge amount corresponding to the operated amount of the control valve, and causes the hydraulic motor M for power generation to rotate by the discharged oil from the second main pump MP2.

The electromagnetic switching valve 11 and the regulators 12, 22 of this embodiment are respectively combined to constitute a control mechanism of this invention, and the discharge amounts of the first and second main pumps MP1, MP2 are controlled by this control mechanism.

As described above, the assist pump AP is connected to the hydraulic motor M for power generation. When the hydraulic motor M for power generation is fulfilling a power generation function in an inoperative state, the tilting angle of the assist pump AP may be minimized so that a load of the assist pump AP hardly acts on the hydraulic motor M for power generation, whereby power generation efficiency may be improved.

If the generator 25 is caused to function as an electric motor during the operation, the assist pump AP rotates to fulfill a pump function. Into which of the first and second main pumps MP1, MP2 the oil discharged from the assist pump AP is joined is controlled by the controller C in accordance with an input signal from the operator. For a junction control, an assist flow rate of the assist pump AP is discharged corresponding to the input signal from the operator and the controller C judges how the tilting angle of the assist pump AP, that of the hydraulic motor M for power generation, the rotation speed of the generator 25 used as an electric motor and the like can be most efficiently controlled and executes the respective controls.

When the operator needs an assist force for both the first and second control systems S1, S2, the controller C keeps the first and second electromagnetic control valves 35, 36 at the closed positions, which is the normal state. When an assist force is needed for either one of the control systems, the controller C switches either one of the first and second electromagnetic control valves 35, 36 to the open position to switch either one of the first and second junction control valves 31, 32 to the closed position. When an assist force is needed for neither one of the first and second control systems S1, S2, the controller C energizes the solenoids of both the first and second electromagnetic control valves 35, 36 to switch the first and second junction control valves 31, 32 to the closed positions.

Since the first and second junction control valves 31, 32 are kept at the open positions in the normal state assuming the assistance of the assist pump AP in this embodiment, it is not necessary to supply electrical signals to the first and second electromagnetic control valves 35, 36 every time the assist of the assist pump AP is needed, and the amount of power consumption can be suppressed by that much.

The embodiment of the present invention has been described above. The above embodiment is merely an illustration of one application example of the present invention and not of the nature to specifically limit the technical scope of the present invention to the above embodiment.

The present application claims a priority based on Japanese Patent Application No. 2010-33526 filed with the Japanese Patent Office on Feb. 18, 2010, all the contents of which are hereby incorporated by reference.

INDUSTRIAL APPLICABILITY

This invention is applicable to construction machines such as hybrid power shovels.

The invention claimed is:

1. A control system for hybrid construction machine, comprising:

a pair of variable-capacity first and second main pumps, the discharge amounts of which are controlled by a control mechanism;

first and second circuit systems connected to the first and second main pumps;

a hydraulic motor for power generation which rotates when oil discharged from at least one of the first and second main pumps is supplied;

a generator coupled to the hydraulic motor for power generation;

a battery which stores power generated by the generator;

a plurality of control valves provided in the first and second circuit systems;

a tank;

a neutral flow path which introduces the oil discharged from the first and second main pumps to the tank when all of the plurality of control valves are at neutral positions; and a regeneration switching valve which is provided in at least one of the first and second circuit systems, communicates with the neutral flow path and the tank at a normal position, and cuts off communication between the neutral flow path and the tank at a switched position to cause the neutral flow path to communicate with the hydraulic motor for power generation.

2. The control system according to claim 1, wherein:

the regeneration switching valve is provided at a most downstream side of the one of the circuit systems.

3. The control system according to claim 1, further comprising:

a controller;

a pilot electromagnetic control valve connected to the controller; and a pilot pump connected to the regeneration switching valve via the pilot electromagnetic control valve;

wherein the regeneration switching valve is switched to the switched position when the pilot electromagnetic control valve is opened in response to an output signal of the controller.

4. The control system according to claim 1, wherein:

the control mechanism for controlling the discharge amount of the other of the first and second main pumps controls the discharge amount of the other main pump to a minimum discharge amount when the regeneration switching valve is switched to the switched position.

* * * * *